United States Patent [19]

Mitsugi et al.

[11] 4,412,113

[45] Oct. 25, 1983

[54] DUST VENTING CONTACT WITH A NON-CIRCULAR HOLE

[75] Inventors: Itaru Mitsugi, Uji; Shunzo Oka, Hirakata; Yoshinobu Nakagawa, Hirakata; Kenichi Shiho, Hirakata, all of Japan

[73] Assignee: Matsushita Electric Industrial Co., Ltd., Kadoma, Japan

[21] Appl. No.: 405,108

[22] Filed: Aug. 4, 1982

Related U.S. Application Data

[63] Continuation of Ser. No. 176,271, Aug. 8, 1980, abandoned.

[30] Foreign Application Priority Data

Aug. 10, 1979 [JP] Japan ..... 54-110666[U]

[51] Int. Cl.[3] ..... H01H 1/18

[52] U.S. Cl. ..... 200/67 DB; 200/242

[58] Field of Search ..... 200/242, 241, 279, 159 B, 200/340, 67 DB

[56] References Cited

U.S. PATENT DOCUMENTS

| | | | |
|---|---|---|---|
| 3,133,170 | 5/1964 | Nanninga | 200/159 B X |
| 3,673,357 | 6/1972 | Molchan | 200/159 B X |
| 3,742,157 | 6/1973 | Leposavic | 200/159 B X |
| 3,982,089 | 9/1976 | Hyltin | 200/159 B |
| 3,996,429 | 12/1976 | Chu et al. | 200/159 B X |
| 4,084,071 | 4/1978 | Smith | 200/159 B X |
| 4,194,105 | 3/1980 | Hodges | 200/159 B |

FOREIGN PATENT DOCUMENTS

| | | | |
|---|---|---|---|
| 735493 | 8/1955 | United Kingdom | 200/67 DA |

*Primary Examiner*—John W. Shepperd
*Assistant Examiner*—Renee Kidorf
*Attorney, Agent, or Firm*—Cushman, Darby & Cushman

[57] ABSTRACT

In a push-on switch comprising a moving contact 6 of partial-hemisphere-face-shaped resilient metal diaphragm which is disposed with its periphery on a pair of peripheral fixed contacts 2b,2b in a contacting manner and at its central part apart above a central fixed contact 2a in an isolated manner at normal state, the improvement is made such that the metal diaphragm moving contact 6 has an opening 6a having at least a protrusion 6b with respect to the opening 6a;

so that the opening 6a allows air to pass at inversing and restoring motions of the central principal part of the moving contact 6, thereby preventing drafting of dust onto the central fixed contact 2a, and that the protrusion 6b slides on and cleans the surface of the central fixed contact 2a at each pushing down of the central part of the moving contact 6.

5 Claims, 7 Drawing Figures

FIG.1
(PRIOR ART)
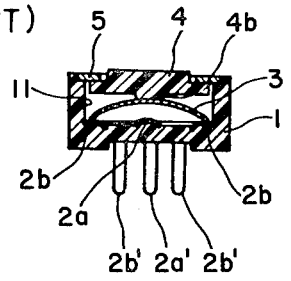
FIG.2(a)
PRIOR ART
FIG.2(b)
PRIOR ART
FIG.2(c)
PRIOR ART
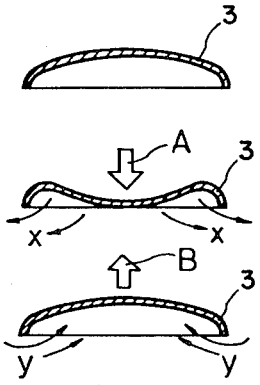
FIG.3
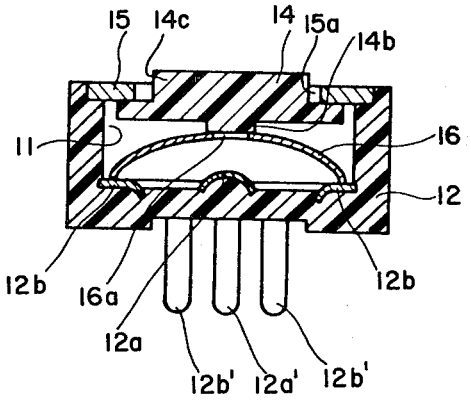

DUST VENTING CONTACT WITH A NON-CIRCULAR HOLE

This is a continuation of application Ser. No. 176,271 filed Aug. 8, 1980, now abandoned.

BACKGROUND OF THE INVENTION

1. Field of the Invention

The present invention relates to an improvement in a structure of an electric switch.

The present invention especially concerns a structural improvement in an electric switch of push-on type wherein the switch turns to an on-state when its actuator is being pushed towards a moving contact member of the switch.

2. Description of the Prior Art

In conventional electric switches of the push-on type, there has been a problem that undesirable dust is likely to be introduced into a space between the moving contact and the fixed contact. Such problem in the conventional switch is elucidated referring to FIG. 1 which is a sectional elevation view of one example of such known push-on type switch, wherein a plastic case 1 contains in its recess 11 a central fixed contact 2*a* at center, a pair of other fixed contacts 2*b*,2*b* at apart position from the center, a known partial-hemisphere-face-shaped resilient metal diaphragm disk 3 as a moving contact disposed spanning and contacting the pair of fixed contacts 2*b*,2*b* with its periphery and a plastic pushing member 4 overriding the moving contact 3. A lid 5 is placed on the case 1 to prevent the pushing member 4 from going out of the case 1. Lead-out terminal tabs 2*a*′ and 2*b*′ are connected to the fixed contacts 2*a* and 2*b*, respectively. When the pushing member 4 is pushed down, a protrusion 4*b* provided underneath thereof pushes the central part of the moving contact 3 as shown by a white arrow A in FIG. 2(*b*), the moving contact quickly changes its form from a normal state shown in FIG. 2(*a*) into a partially inversed strained state of FIG. 2(*b*), and the central part of the diaphragm-shaped moving contact 3 touches the central fixed contact 2*a*. When the pushing force to the pushing member 4 is removed, then the moving contacts restores to initial normal state as shown by FIG. 2(*c*), thereby pushing up the pushing member 4 as shown by a white arrow B.

When the diaphragm-shaped moving contact 3 quickly changes its shape from the normal state of FIG. 2(*a*) to the strained state of FIG. 2(*b*), air in the space covered by the moving contact 3 is pushed out as shown by arrows x,x in FIG. 2(*b*), and when the moving contact 3 restores from the strained state of FIG. 2(*b*) to the normal state of FIG. 2(*c*), air is sucked into the space under the moving contact 3 as shown by arrows y,y in FIG. 2(*c*). When the air is sucked into the space, dust in the recess 11 of the case is brought into the space and on the central fixed contact 2*a*. Such dust is then pressed on the surfaces of the fixed contact or the moving contact by contacting of fairly smooth flat faces thereof. Therefore, the dust is likely to stay there and thereby becomes an obstacle against good contact.

SUMMARY OF THE INVENTION

Therefore the present invention purports to provide an improved switch capable of reliable good contact for a long time, by adopting a novel improved structure of its moving contact of partial-hemisphere-face-shaped metal diaphragm moving contact.

BRIEF DESCRIPTION OF THE DRAWING

FIG. 1 is the sectional elevation view of the example of the conventional push-on type switch.

FIG. 2(*a*), FIG. 2(*b*) and FIG. 2(*c*) are sectional side views of the partial-hemisphere-face-shaped resilient metal diaphragm moving contact 3 for elucidation of its motion.

FIG. 3 is a sectional elevation view of an example switch embodying the present invention.

DETAILED DESCRIPTION OF PREFERRED EMBODIMENT

A switch in accordance with the present invention comprises a case having a recessed space therein, a central fixed contact fixedly disposed at the central part on the bottom face of said recessed space, at least one peripheral fixed contact fixedly disposed at a peripheral part on the bottom face of said recessed space, a moving contact of resilient metal diapragm which is shaped in a partial-hemisphere-face and has a nature that a principal part at the central part quickly moves between a normal state where said principal part is on said hemisphere face when no force is applied thereon and a strained state where said principal part is pushed down thereby said principal part forming upside-down inversed partial-hemisphere-face, an actuation member having a pushing part thereunder and disposed in a manner that said pushing part touches the top face of the central part of said moving contact, and is characterized in that said moving contact has an opening, peripheral line of which has at least one protrusion into said opening.

A detailed description is made for preferred examples in reference to the accompanying drawing.

Figure 4:
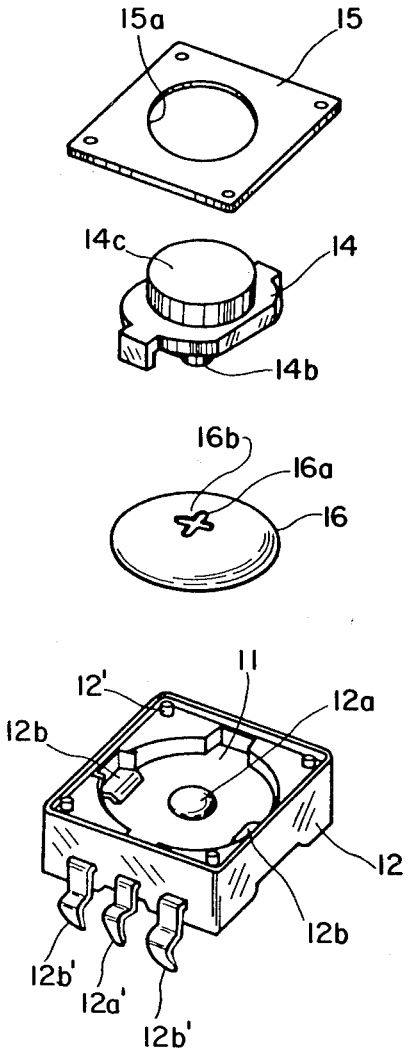
FIG. 4 is an exploded perspective view of the switch shown in FIG. 3.

FIG. 3 is a sectional elevation view and FIG. 4 is an exploded perspective view of an example of a switch embodying the present invention.

A case 1 of the switch is made of a plastic mold, wherein connecting leads from lead-out terminal tabs 2*b*′,2*b*′ and 2*a*′ to peripheral fixed contacts 2*b*,2*b* and to a central fixed contact 2*a*, respectively, and buried in the mold. The case 1 is shaped is a box having a recessed space 11 therein. The central fixed contact 2*a* at the central part and a pair of the peripheral fixed contact 2*b*,2*b* are provided on the bottom face in the recessed space 11 of the case 1. A moving contact 6 made of resilient metal in a shape of a disk of a known partial-hemisphere-face like shape is disposed in the recessed space 11, so that periphery thereof is on the peripheral fixed contacts 2*b*,2*b* and the central part thereof is apart above the central fixed contact 2*a*. The moving contact 6 has at the central part thereof at least an opening 6*a*, which has at least one protrusion 6*b* into the opening. The periphery of the opening at the part other than the protrusion 6b is shaped round, that is, edge-shaped indent is omitted from the periphery, in order to prevent undesirable concentration of strain to such edge shaped part of the periphery at the motions of the moving contact 6. Thereby, attaining of long and stable performance of the moving contact becomes possible. An actuator 4 made of a plastic material and having a pushing part 4b thereunder is then placed on the moving contact 6, and a lid 5 having an opening 5a is fixed on the case 1 in a manner to expose an upper protrusion 4c of the actuator 4 from the opening 5a. As a modification, any shape of motion linkage means can be formed on or connected to the actuator, so as to convey switching motion from any kind of knob or mechanical linkage.

Figure 6:
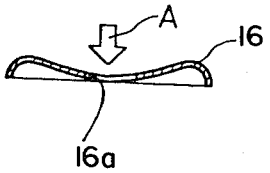
FIG. 6 is a sectional side view of the moving contact 6 at its strained state.

The operation and function of the switch shown by FIG. 3 and 4 is as follows: When the actuator 14 is pushed down, the moving contact 16 is pressed at its central part by the pushing part 14b of the actuator 14, and accordingly, the principal part, which is other than the peripheral part, of the moving contact 16 is quickly inversed from the normal state shown in FIG. 3 downwards to a strained state shown by FIG. 6. When the pushing force of the actuator 14 is released, the moving contact 16 quickly restores its state to the normal hemisphere-face-shape of FIG. 3, thereby pushing up the actuator 14. In such both changing motions of the diaphragm of the moving contact 16 from the normal state and inversed state and vise versa, the opening 16 of the moving contact 16 allows air to pass therethrough. Any dust that is located on the contact 12a in FIG. 3 will not be pushed into the surface of the contact by the undersurface of the movable contact since there is an opening provided. Accordingly, the problem that the dust is sucked onto the central fixed contact 12a and pressed between it and the moving contact is eliminated.

Furthermore, the protrusion 16b into the opening 16a of the metal contact 16 serves cleaning motion at each touching down thereof on the fixed contact 12a. That is, at each touching down of the central part of the moving contact 16, the protrusions 16b slide on the surface of the central fixed contact for about 10 μm, thereby making reliable contact by means of a cleaning of the faces of both contacts by the sliding motions. Also, by providing the protrusions 16b, the contact between the moving contact 16 and the central fixed contact 12a becomes point contactings or line contactings instead of face to face contacting of the conventional switch like that of FIG. 1. Therefore, contacting pressure per contacting area becomes very high in comparison with the conventional devices, and hence, the obstacle by the dust against contacting is easily eliminated.

Figure 5A:
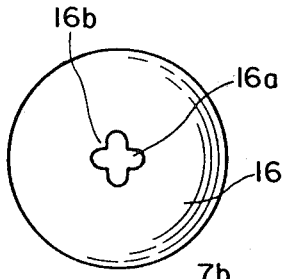
FIG. 5(*a*), FIG. 5(*b*) and FIG. 5(*c*) are plan views of examples of resilient metal diaphragm moving contacts of the switch of the present invention.
Figure 5B:
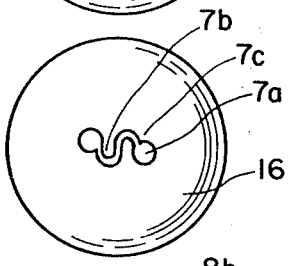
Figure 5C:
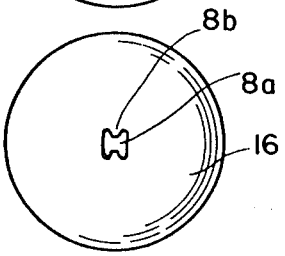

FIG. 5(*a*), FIG. 5(*b*) and FIG. 5(*c*) are plan views showing various examples of opening on the moving contact diaphragm 16. FIG. 5(*a*) shows the example shown by FIG. 3 and FIG. 4 where the opening 16a is a cross-shape with round ends. This example has four protrusions 16b at the corners of crossing of straight parts of periphery. FIG. 5(*b*) shows another example of the opening 7a, which is formed by connecting a pair of circle-shaped holes with a gently bent slit. In this example, two kinds of protrusions 7b and 7c are formed. FIG. 5(*c*) shows still another example of the opening 8a, which is formed like the letter H with rounded ends. The opening has a pair of protrusions 8b of the same shape. Though these examples show openings having more than two protrusions, an opening having at least one protrusion is usable. However, providing of two or more protrusions in the opening is preferable since plural protrusions provide plural touchings with sliding cleanings of the contacts, thereby assuring a higher reliability of good contacting.

Figure 7:
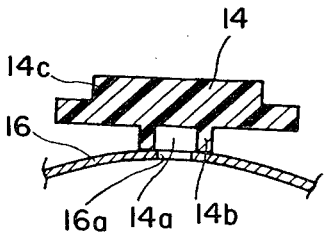
FIG. 7 is a sectional view of a modified example of actuating member 4.

FIG. 7 is sectional side view showing an improved pushing part 14b of the actuation member 14, wherein the pushing part 14b is formed to have pushing face(s) (underneath face(s)) provided with a hole or space therein so as to contact the top face of the moving contact diaphragm 16 at the part outside the opening 16b (or 7a or 8a), so that the protrusions 16b (or 7b, 7c or 8b) do not slide on the pushing face of the pushing part 14b, thereby preventing undesirable production of dust of the plastic material of the pushing part 7b. For example, the pushing part 14b can be formed in a ring shape, which ring should have an inner diameter larger than the size of the opening 16a (or 7a or 8a). Also, the pushing part 14b can also be an interrupted ring or several dots disposed around the space 14a, and therefore the sectional side view of FIG. 7 covers the cases of the ring shape, interrupted ring shape and dots disposed around the space 14a which is outside the opening 16a (or 7a or 8a).

What we claim is:

1. A switch comprising:

a case having a recessed space therein;

a central fixed contact disposed at the center of the bottom face of said recessed space;

at least one peripheral fixed contact fixedly disposed at a peripheral part of the bottom face of said recessed shape;

a movable contact of resilient metal which is partially hemispherically shaped with a central portion movable between a normal state where said resilient metal is unflexed and no force is applied thereto and a strained state where said central portion is pushed down;

an actuation member having a pushing part movable in engagement with said central portion of said moving contact;

the improvement comprising said central portion of said moving contact having an opening, said opening having a peripheral edge at least a portion of which projects into said opening whereby said opening is non-circular.

2. A switch in accordance with claim 1 wherein said actuation member has a pushing part which is formed under said actuator and has at least an opening on the bottom face thereof.

3. The switch as claimed in claim 1 wherein said pushing part is in the form of an interrupted ring.

4. A switch in accordance with claim 1, wherein said opening is shaped into a cross having rounded ends.

5. A switch in accordance with claim 1, wherein inner diameter of said opening of said actuator is larger than said opening on said moving contact.

* * * * *